US010676339B2

(12) United States Patent
Karol et al.

(10) Patent No.: US 10,676,339 B2
(45) Date of Patent: Jun. 9, 2020

(54) BEVERAGE DISPENSING SYSTEM

(71) Applicant: PepsiCo, Inc., Purchase, NY (US)

(72) Inventors: Sam Karol, Purchase, NY (US); Robert W. Balstad, New Milford, CT (US); Anthony Romano, Purchase, NY (US); Alberto Pravato, Venice (IT); Alessandro Roncato, Venice (IT)

(73) Assignee: PepsiCo, Inc., Purchase, NY (US)

( * ) Notice: Subject to any disclaimer, the term of this patent is extended or adjusted under 35 U.S.C. 154(b) by 24 days.

(21) Appl. No.: 15/845,766

(22) Filed: Dec. 18, 2017

(65) Prior Publication Data

US 2019/0185311 A1 Jun. 20, 2019

(51) Int. Cl.
*B67D 1/12* (2006.01)
*B67D 1/10* (2006.01)
(Continued)

(52) U.S. Cl.
CPC ..... *B67D 1/1247* (2013.01); *B67D 1/0081* (2013.01); *B67D 1/10* (2013.01); *B67D 1/1206* (2013.01); *B67D 1/1211* (2013.01); *B67D 1/0014* (2013.01); *B67D 1/0021* (2013.01); *B67D 1/0044* (2013.01); *B67D 1/0057* (2013.01); *B67D 1/0888* (2013.01);
(Continued)

(58) Field of Classification Search
CPC ..... B67D 1/1247; B67D 1/0081; B67D 1/10; B67D 1/1211; B67D 1/1206; B67D 1/0014; B67D 1/0021; B67D 1/0044; B67D 1/0057; B67D 1/0888; G07F 13/065
See application file for complete search history.

(56) References Cited

U.S. PATENT DOCUMENTS 3,825,154 A * 7/1974 Jaeger ..... B67D 1/10 222/136
5,082,143 A * 1/1992 Schramm, Jr. ..... G07F 13/065 222/129.1
(Continued)

FOREIGN PATENT DOCUMENTS

WO 02070396 A1 9/2002
WO WO-02070396 A1 * 9/2002 ..... B67D 1/0041

OTHER PUBLICATIONS

Notification of Transmittal of the International Search Report and the Written Opinion of the International Searching Authority, or the Declaration for PCT/US2018/66135, dated Mar. 5, 2019, 8 pages.

*Primary Examiner* — Nicholas J. Weiss
(74) *Attorney, Agent, or Firm* — Sterne, Kessler, Goldstein & Fox P.L.L.C.

(57) ABSTRACT

A method of determining a sold-out state of a beverage dispenser is provided. The method includes providing a beverage dispenser including a pump having a gas exhaust port, a dispensing valve, and a sensor disposed on the pump gas exhaust port. The method may include activating the beverage dispenser to dispense a beverage through the dispensing valve and during the activating, sensing a gas exhaust pattern of the pump. The method may also include generating a signal based on the sensed gas exhaust pattern and determining whether the beverage dispenser is in a normal-pour state or a sold-out state. The method may also include providing feedback about the sold-out state to a user interface of the beverage dispenser.

17 Claims, 13 Drawing Sheets

(51) Int. Cl.
*B67D 1/00* (2006.01)
*B67D 1/08* (2006.01)
*G07F 13/06* (2006.01)

(52) U.S. Cl.
CPC ..... *B67D 2001/1263* (2013.01); *B67D 2210/00091* (2013.01); *G07F 13/065* (2013.01)

(56) References Cited

U.S. PATENT DOCUMENTS

| | | | | |
|---|---|---|---|---|
| 5,730,324 | A * | 3/1998 | Shannon | B67D 1/0021 222/129.1 |
| 5,757,667 | A * | 5/1998 | Shannon | B67D 1/0884 222/65 |
| 6,053,361 | A | 4/2000 | Hills | |
| 6,094,142 | A | 7/2000 | Lu | |
| 6,382,464 | B1 * | 5/2002 | Uzawa | B67D 1/0037 222/129.1 |
| 6,402,478 | B1 | 6/2002 | Zhang et al. | |
| 7,631,788 | B2 * | 12/2009 | Litterst | B67D 1/102 222/1 |
| 2003/0121937 | A1 | 7/2003 | Black et al. | |
| 2016/0176694 | A1 * | 6/2016 | Vinci | B67D 1/0888 340/618 |
| 2016/0257549 | A1 * | 9/2016 | Volftsun | B67D 1/0007 |

* cited by examiner

BEVERAGE DISPENSING SYSTEM

BACKGROUND

Field

Embodiments of the present invention relate to post-mix dispensers to dispense a beverage.

Background

Post-mix dispensers typically permit a beverage to be created on-demand from a mixture of ingredients. An advantage of dispensing beverages in this form is that the concentrate containers and water supply typically occupy significantly less space than is otherwise required to store the same volume of beverage in individual containers. Moreover, this dispensing equipment reduces waste formed by the empty individual containers and additional transport costs. These and other technological advances have allowed food and beverage vendors to offer more diverse choices to consumers through post-mix dispensing systems.

Typically, in a post-mix dispenser, a fluid or a beverage concentrate is supplied from a source for example, a bag-in-box (BIB) container. The beverage concentrate mixes with a diluent, for example, water or carbonated water, to form a finished beverage. A BIB container stores a predetermined volume of the beverage concentrate and must be replenished or replaced, as required.

Traditional post-mix beverage dispensing systems can determine when the fluid or the beverage concentrate source is empty, i.e. a "sold-out" state of the beverage in the beverage dispensing system. For example, the beverage dispensing system can utilize a pressure switch in the supply line of the fluid to the beverage dispenser to determine when the fluid or beverage concentrate source is sold-out. Though reliable, the pressure switches and associated componentry can be expensive to install and maintain.

BRIEF SUMMARY OF THE INVENTION

One aspect of the invention provides a cost-effective method to determine the sold-out state for one or more beverages in a beverage dispensing system based on the behavior of a pump. For example, a pump behavior can change based on whether the pump is displacing fluid or attempting to displace air, or combinations thereof. The pump may be configured to supply a beverage, a beverage concentrate, or a diluent. A sensing apparatus that monitors the pump behavior generates a signal based on the pump behavior and an algorithm can analyze the generated signal to identify the supply condition of the pump. The supply condition corresponds to whether the beverage concentrate source and thus the supply line is "filled" or "empty." A filled supply line corresponds to a normal-pour state, i.e. the beverage can be selected and dispensed, while an empty supply line corresponds to a sold-out state of the beverage, i.e. the beverage is not available for sale and/or to be dispensed. A control module can communicate the state of the beverage in the beverage dispensing system to a user interface of the beverage dispenser and the user interface can prevent a user from selecting a "sold-out" beverage.

Another aspect of the invention provides a cost-effective method to determine the sold-out state for one or more beverages in a beverage dispensing system based on the gas exhaust behavior of a pump. For example, the gas exhaust behavior of a pump can change based on whether the pump is displacing fluid or attempting to displace air, or combinations thereof. The pump may be configured to supply a beverage, a beverage concentrate, or a diluent. A sensing apparatus that monitors the pump gas exhaust behavior generates a signal based on the pump gas exhaust behavior and an algorithm can compare, the generated signal to identify the supply condition of the pump. The supply condition corresponds to whether the beverage concentrate source and thus the supply line is "filled" or "empty". A filled supply line corresponds to a normal-pour state while an empty supply line corresponds to a sold-out state of the beverage in the beverage dispensing system. A control module can communicate the state of availability of the beverage in the beverage dispensing system to a user interface of the beverage dispenser and the user interface can prevent a user from selecting a "sold-out" beverage.

In one aspect of the invention, a sensing apparatus can include a sensor housing having an interior area fluidly connected to a pump gas exhaust port, and a sensor positioned within the interior area. The sensor can generate a first signal representative of a first supply condition of the pump, and a second signal representative of a second supply condition of the pump. The first supply condition represents a "filled" supply condition of the pump, and the second supply condition represents an "empty" supply condition of the pump. In a further aspect of the invention, the sensing apparatus can also include a sensor activation device disposed in a channel, the channel connecting the interior area to the pump gas exhaust port. The sensor activation device can interact with the sensor to generate one of the first and the second signal.

In another aspect of the invention, a method of determining a sold-out state of a beverage in a beverage dispensing system can include providing a beverage dispenser including a pump having a gas exhaust port, a dispensing valve, and a sensor disposed on the pump gas exhaust port. The method can include activating the beverage dispenser to dispense a beverage through the dispensing valve and during the activating, sensing a gas exhaust pattern of the pump. The method can also include generating a signal based on the sensed gas exhaust pattern and determining whether the beverage dispenser is in a normal-pour state or a sold-out state.

In a further aspect of the invention, the method of determining a sold-out state of a beverage in a beverage dispensing system can also include providing feedback about the sold-out state to a user interface of the beverage dispenser.

In one aspect of the invention, the method can include the sensor generating a signal based on an operating pattern of the pump. For example, the sensor can generate a first signal based on a first operating pattern of the pump representative of the normal-pour state, and a second signal based on a second operating pattern of the pump representative of the sold-out state of the beverage in the beverage dispensing system. In a further aspect of the invention, the method can also include a control module configured to receive the first and the second signal and the control module can determine the state of the beverage in the beverage dispensing system based on the received signal. In a further aspect of the invention, determining the state of availability of the beverage in the beverage dispensing system can include comparing the first and the second operating pattern of the pump. In a further aspect of the invention, an algorithm or a software program can be used to determine the state of availability of the beverage in the beverage dispensing system.

In another aspect of the invention, the method can include the sensor generating a signal based on a gas exhaust pattern of the pump. For example, the sensor can generate a first signal based on a first gas exhaust pattern of the pump representative of the normal-pour state, and a second signal based on a second gas exhaust pattern of the pump representative of the sold-out state of the beverage in the beverage dispensing system. In a further aspect of the invention, the method can also include a control module configured to receive the first and the second signal and the control module can determine the state of availability of the beverage in the beverage dispensing system based on the received signal. In a further aspect of the invention, determining the state of availability of the beverage in the beverage dispensing system can include comparing the first and the second gas exhaust pattern of the pump. In a further aspect of the invention, an algorithm or a software program can be used to determine the state of availability of the beverage in the beverage dispensing system.

In another aspect of the invention, a beverage dispensing system can include a beverage dispenser including a pump, a sensing apparatus connected to the pump, the sensing apparatus including a sensor wherein the sensor generates a signal representative of an operating condition of the pump, the operating condition of the pump dependent on the supply of the beverage concentrate in the supply lines. The sensor can generate a first signal representative of a first operating condition of the pump, and the sensor can generate a second signal representative of a second operating condition of the pump. The beverage dispensing system can also include a control module configured to communicate with the sensor and a user interface in communication with the control module configured to provide feedback to a user. The feedback can include a sold-out state of a beverage in the beverage dispensing system.

In another aspect of the invention, a beverage dispensing system can include a beverage dispenser including a pump, a sensing apparatus connected to a gas exhaust port of the pump, the sensing apparatus including a sensor wherein the sensor generates a signal representative of an operating condition of the pump, the operating condition of the pump dependent on the supply of the beverage concentrate in the supply lines. The sensor can generate a first signal representative of a first operating condition of the pump, and the sensor can generate a second signal representative of a second operating condition of the pump. The beverage dispensing system can also include a control module configured to communicate with the sensor and a user interface in communication with the control module configured to provide feedback to a user. The feedback can include a sold-out state of a beverage in the beverage dispensing system.

Further features and advantages of embodiments of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to a person skilled in the relevant art(s) based on the teachings contained herein.

BRIEF DESCRIPTION OF THE DRAWINGS/FIGURES

The accompanying drawings, which are incorporated herein and form part of the specification, illustrate embodiments of the present invention and, together with the description, further serve to explain the principles of the invention and to enable a person skilled in the relevant art(s) to make and use the invention.

Features and advantages of the embodiments will become more apparent from the detailed description set forth below when taken in conjunction with the drawings, in which like reference characters identify corresponding elements throughout.

DETAILED DESCRIPTION OF THE INVENTION

The present invention(s) will now be described in detail with reference to embodiments thereof as illustrated in the accompanying drawings. References to "one embodiment", "an embodiment", "an exemplary embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The embodiments discussed below may be used to form a wide variety of products, such as beverages, including but not limited to cold and hot beverages, and including but not limited to beverages known under any PepsiCo branded name, such as Pepsi-Cola®.

Aspects of the present invention will now be described with reference to FIGS. 1-11. Throughout the system, conventional beverage tubing (FDA approved for use with food products) is used to connect the components of the system. Any of the beverage tubing conduits may be insulated to prevent heat loss or gain.

Figure 1:
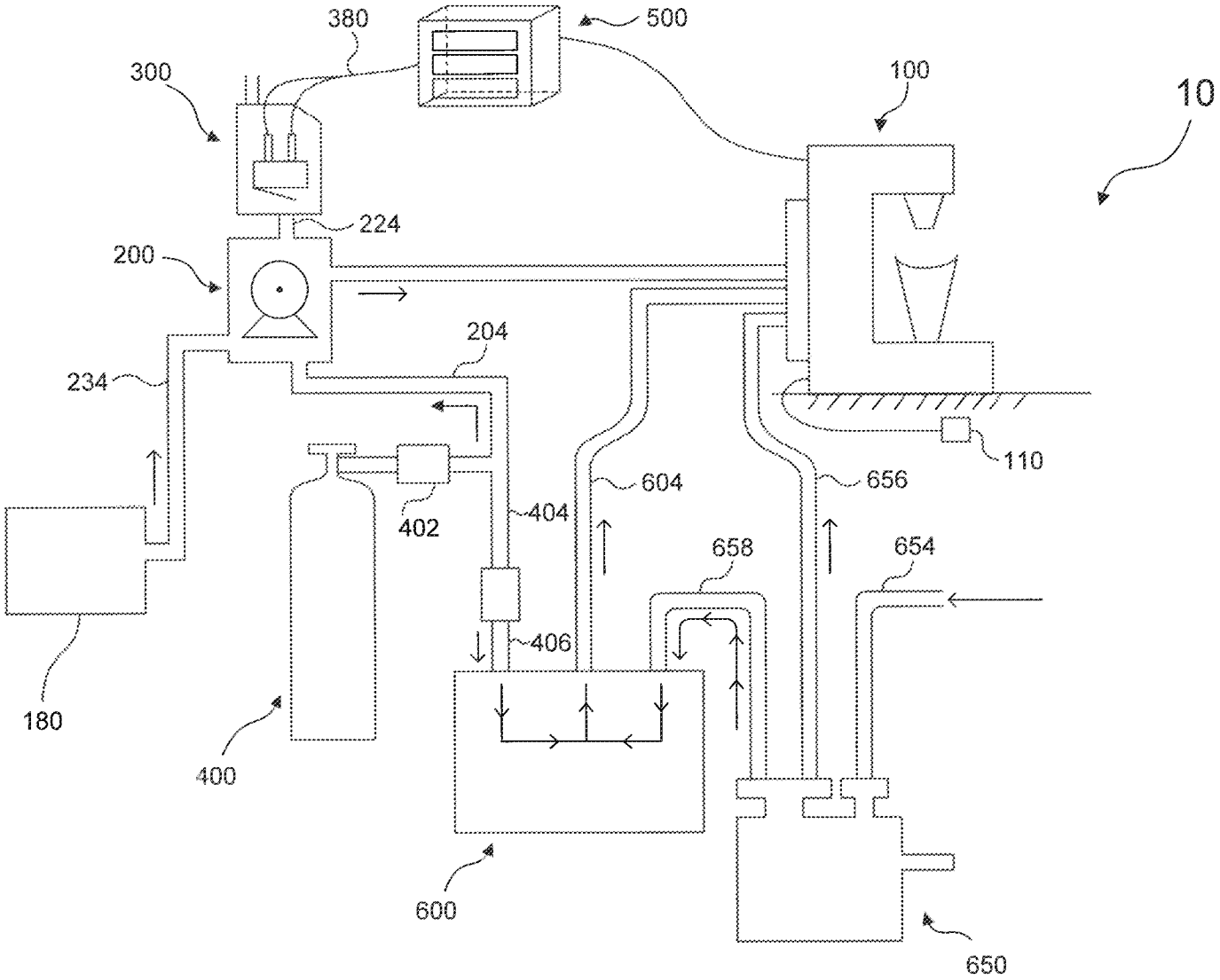
FIG. 1 is a schematic of a beverage dispensing system 10 according to various aspects of the invention.

FIG. 1 shows a schematic of a beverage dispensing system 10. The beverage dispensing system 10 can include, but is not limited to, one or more of a beverage dispenser 100, a concentrate source 180, a pump 200, a sensing apparatus 300, a gas source 400, a control module 500, a carbonator 600, and a diluent source 650. In one aspect of the invention, a compressed-gas source 400 supplies compressed gas to pump 200 through gas inlet line 204 and a concentrate source 180 supplies fluid to pump 200 through fluid inlet line 234. Pump 200 supplies fluid to beverage dispenser 100 through fluid supply line 244 and pump 200 exhausts compressed gas through gas exhaust line 224.

Beverage dispensing system 10 can include one or more pumps 200 configured to supply a beverage, a beverage concentrate, a syrup, or a flavoring from a concentrate source 180 to beverage dispenser 100. Pump 200 can include a mechanical pump, an electrical pump, a hydraulic pump, a pneumatic pump, or other suitable pumping device. In some aspects of the invention, pump 200 can be a compressed gas powered BIB pump. A BIB pump can include a built-in concentrate source 180 and can supply a beverage, a syrup, a beverage concentrate, and/or flavorings to a post-mix beverage dispenser.

Figure 2:
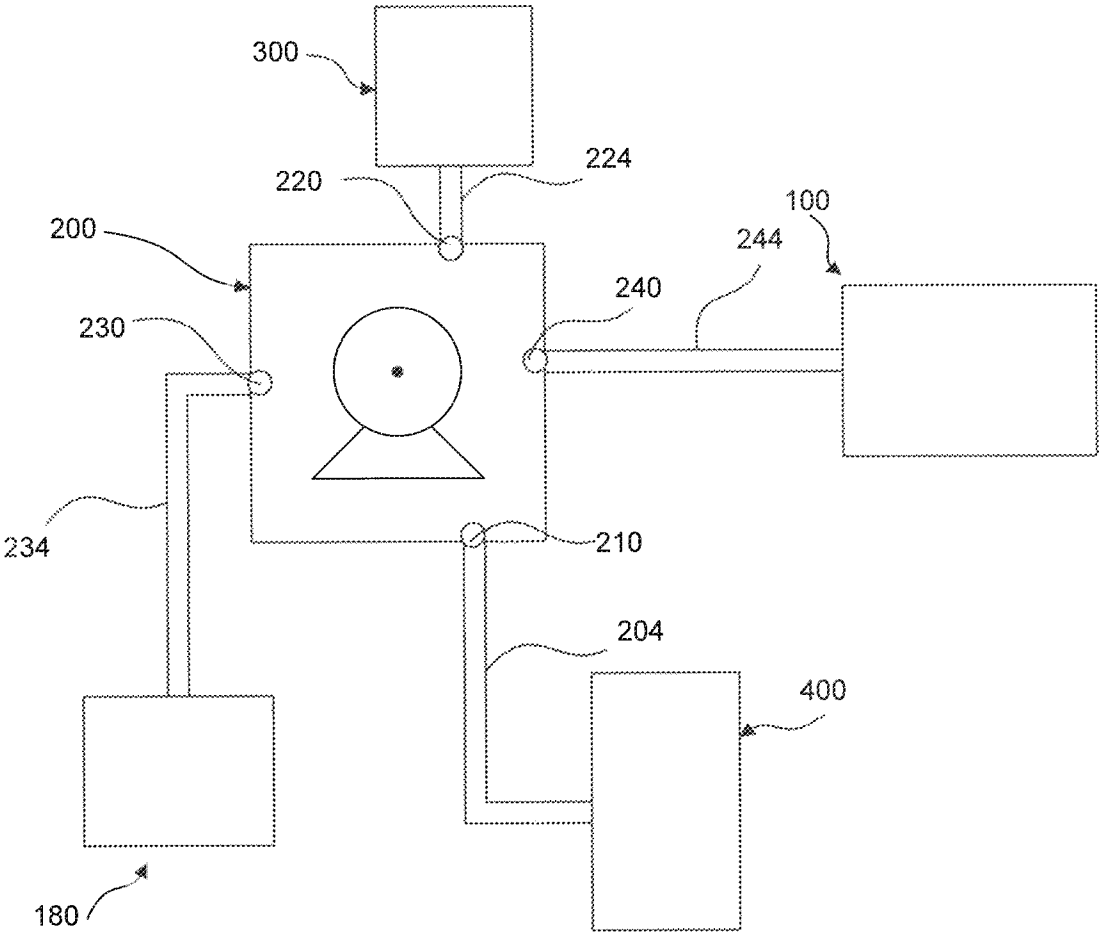
FIG. 2 is a schematic of a beverage dispensing system 10 according to various aspects of the invention.
Figure 3:
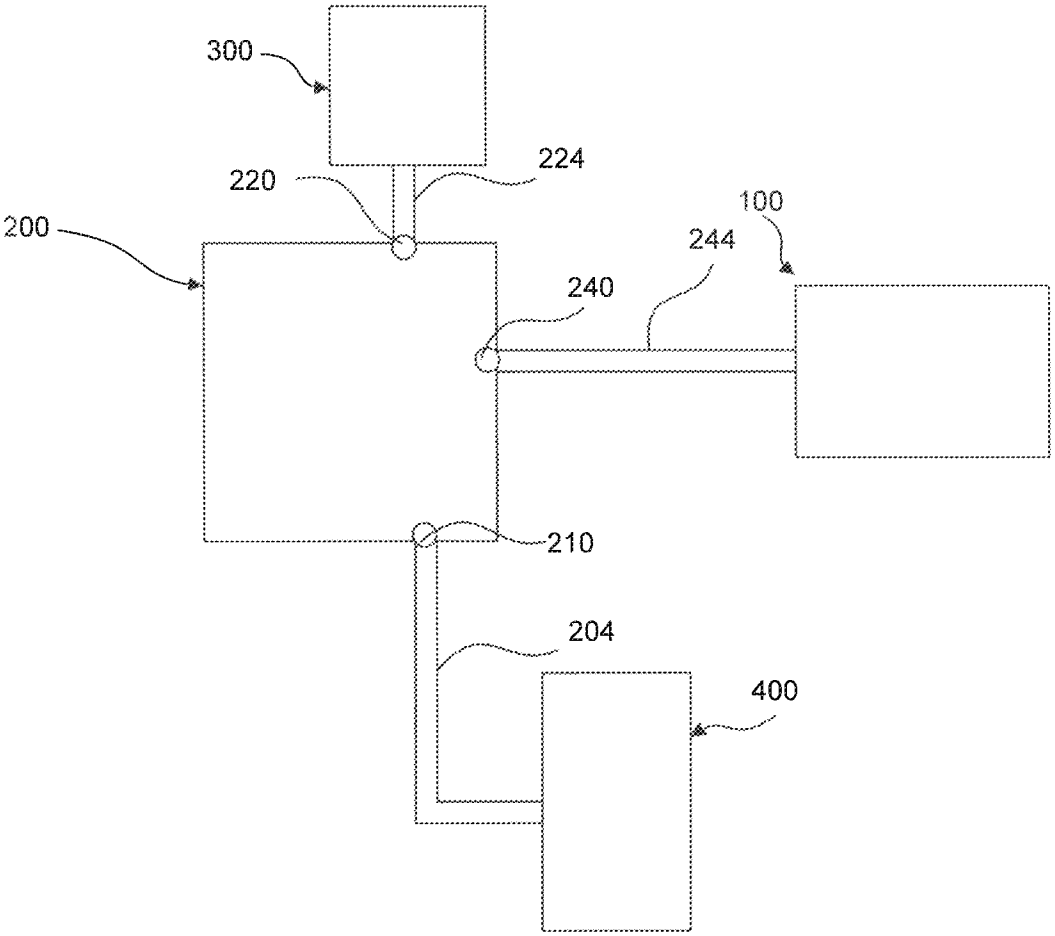
FIG. 3 is a schematic of a beverage dispensing system 10 according to various aspects of the invention.

As shown in FIG. 2, pump 200 can include a gas inlet port 210, a gas exhaust port 220, a fluid inlet port 230, and a fluid supply port 240. In one aspect of the invention, where a BIB pump is used, incoming fluid can be contained in a container housed within pump 200, as shown in FIG. 3. A compressed-gas source 400 can supply compressed gas to pump 200 at gas inlet port 210 through gas inlet line 204, a concentrate source 180 can supply fluid to pump 200 at fluid inlet port 230 through inlet line 234, and pump 200 can supply fluid to beverage dispenser 100 through supply line 244. A sensing apparatus 300 can be connected to gas exhaust port 220 through exhaust line 224. In some aspects of the invention, a compressed gas source 400 can include compressed air, $CO_2$, $N_2$, or a combination thereof.

In an aspect, pump 200 can be an air operated double diaphragm pump. An air operated double diaphragm pump is a type of positive displacement pump that uses compressed air as a power source. The compressed air is shifted from one chamber to the other by a linked shaft that allows the chambers to move simultaneously. This back-and-forth motion forces liquid out of one chamber and into an outlet while the other chamber is being filled with liquid at the same time. These pumps use reciprocating elastomeric diaphragms and check valves to pump fluid. The liquid chambers are filled and emptied by fluid that is drawn through a common inlet and discharged through a single outlet, e.g., gas exhaust line 224. This supply and subsequent exhaust of the compressed air to a single diaphragm is considered to be a pump activation, as discussed with respect to FIGS. 9 and 10 below. Fluid continues to dispense for each pump activation during operation of the pump. Because the pump is drawing fluid from a fixed volume source, e.g. concentrate source 180, the amount of time between pump activations during operation increases as the amount of fluid in the fixed volume source decreases due to increased pressure. The amount of time between pump activations can range from approximately 2 seconds for a full concentrate source 180, i.e. normal-pour state, to approximately 50 seconds for an empty concentrate source 180, i.e. sold-out state.

In an aspect of the invention, compressed gas source 400 can supply compressed gas to carbonator 600 through gas line 404. The flow of compressed gas can be regulated using a flow regulator 402. Flow regulator 402 can also include a flow valve to distribute the flow of compressed gas to one or both of gas lines 204 and 404. Beverage dispensing system 10 can include one or more compressed gas sources 400. A pressure switch 406 can be installed in gas line 404 between flow regulator 402 and carbonator 600.

In a further aspect of the invention, beverage dispensing system 10 can include one or more diluent sources 650 to supply a diluent, e.g., water or carbonated water, to beverage dispenser 100. In one aspect, the diluent can be at typical domestic water pressures, e.g., approximately 50-300 pounds per square inch (psi). Diluent source 650 can include a water line 654 directly connected from the water source and supplying diluent to diluent source 650, for example, tap water or filtered tap water. In another aspect of the invention, a diluent can be directly connected beverage dispenser 100 (not illustrated in FIG. 1). Alternatively, diluent source 650 can include a water booster or a water pump installed such that water from a water inlet line 654 is supplied to beverage dispenser 100 through line 656. In some aspects of the invention, diluent source 650 may also supply diluent to carbonator 600 through line 658.

In one aspect of the invention, carbonator 600 can also include a pump to supply carbonated water through line 604 to beverage dispenser 100. Carbonator 600 can form carbonated water by processing diluent supplied through line 658 and compressed gas through gas line 404.

In some aspects of the invention, beverage dispenser 100 can include a beverage dispensing valve 140. Beverage concentrate can be supplied to beverage dispenser 100 and can mix with the diluent at beverage dispensing valve 140. The use of a post-mix system that directly mixes the concentrate and diluent at beverage dispensing valve 140 can avoid cross-contamination of multiple concentrate sources and can reduce the unwanted growth of bacteria within beverage dispenser 100.

Figure 6:
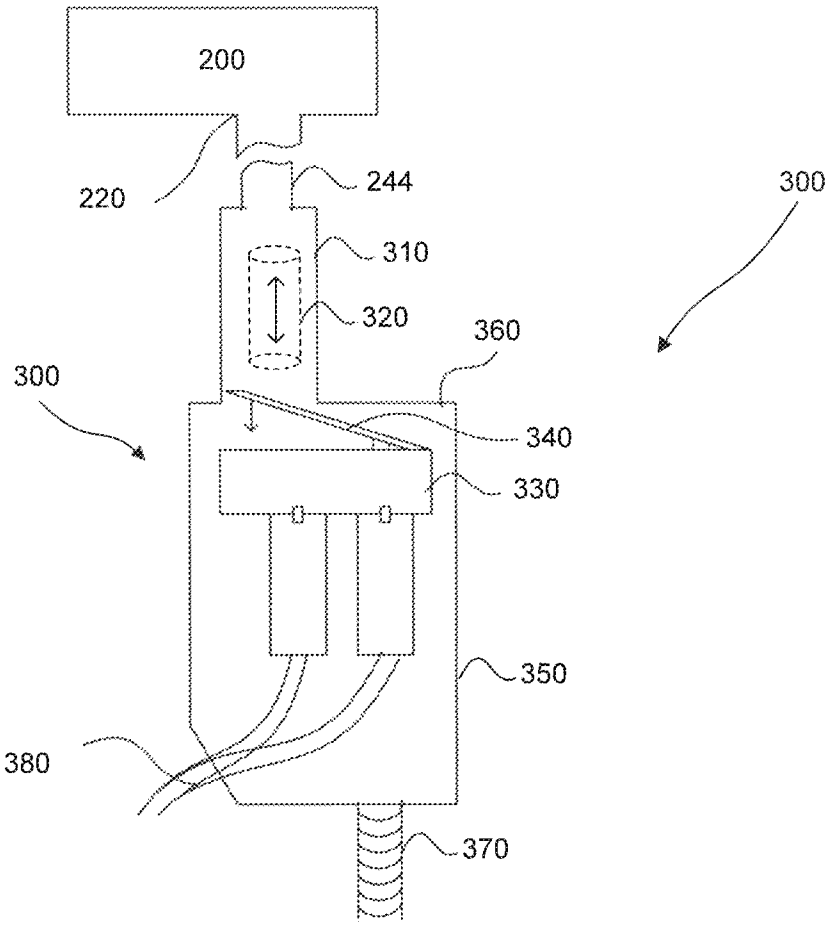
FIG. 6 is a schematic of a sensing apparatus 300 according to various aspects of the invention.

Beverage dispensing system 10 can utilize a sensing apparatus 300 to determine a sold-out state of a beverage. Sensing apparatus 300 is shown in FIG. 6. In an aspect, sensing apparatus 300 can determine a supply condition of pump 200. For example, sensing apparatus 300 can determine whether pump 200 is pumping diluent, e.g. in the normal-pour state, or attempting to pump from an empty concentrate source 180, e.g. in the sold-out state. Sensing apparatus 300 can include a sensor housing 350 having an interior area 360. The interior area 360 within sensor housing 350 can be fluidly connected to gas exhaust port 220 of pump 200, for example, through exhaust line 244. The sensing apparatus can also include a sensor 330, a sensor actuator 340, and a sensor activation device 320 disposed in channel 310 of sensor housing 350. The flow of pump 200 exhaust gases can push sensor activation device 320 into sensor actuator 340 to activate sensor 330. In an aspect, sensor 330 can be a pressure switch, sensor actuator 340 can be a lever, and sensor activation device 320 can be a movable piston that travels in response to a supply condition of pump 200.

Sensor housing 350 can be detachably connected to gas exhaust port 220 of pump 200 via a threaded connection, gluing, thermal bonding, welding, pressure sealing, or by using other suitable means. A leak-free seal between sensor housing 350 and gas exhaust port 220 of pump 200 is preferred for reliable sensing of pump gas exhaust and safety. Sensing apparatus can also include an exhaust channel 370 configured to exhaust the gas to ambient atmosphere or an exhaust gas filter. In a further aspect of the invention, sensing apparatus 300 can also include one or more electrically conducting cables 380 that electrically connect sensor 330 to other components of beverage dispensing system 10.

In an aspect of the invention, sensor 330 can include a microphone. In this aspect, sensor 330 can determine a supply condition of pump 200 based on generated sound waves in the form of air pressure vibrations. For example, sensing apparatus 300 can determine whether pump 200 is pumping diluent, e.g. in the normal-pour state, or attempting to pump from an empty concentrate source 180, e.g. in the sold-out state. The air pressure vibrations can be representative of a supply condition of pump 200 and can be generated in different patterns based on the presence or absence of fluid concentrate from concentrate source 180. The air pressure vibrations from the pump gas exhaust can be converted into electrical signals via sensor 330 and the electrical signals can be received and processed by a control module.

In another aspect of the invention, sensor 330 can include a flowmeter. In this aspect, sensor 330 can determine a supply condition of pump 200 based on the flow of exhaust gas leaving pump 200. For example, sensing apparatus 300 can determine whether pump 200 is pumping diluent, e.g. in the normal-pour state, or attempting to pump from an empty concentrate source 180, e.g. in the sold-out state. The flow of exhaust gas can be representative of a supply condition of pump 200 and can be generated in different patterns based on the presence or absence of fluid concentrate from concentrate source 180. The flow of exhaust gas from the pump can be converted into electrical signals via sensor 330 and the electrical signals can be received and processed by a control module.

Figure 5:
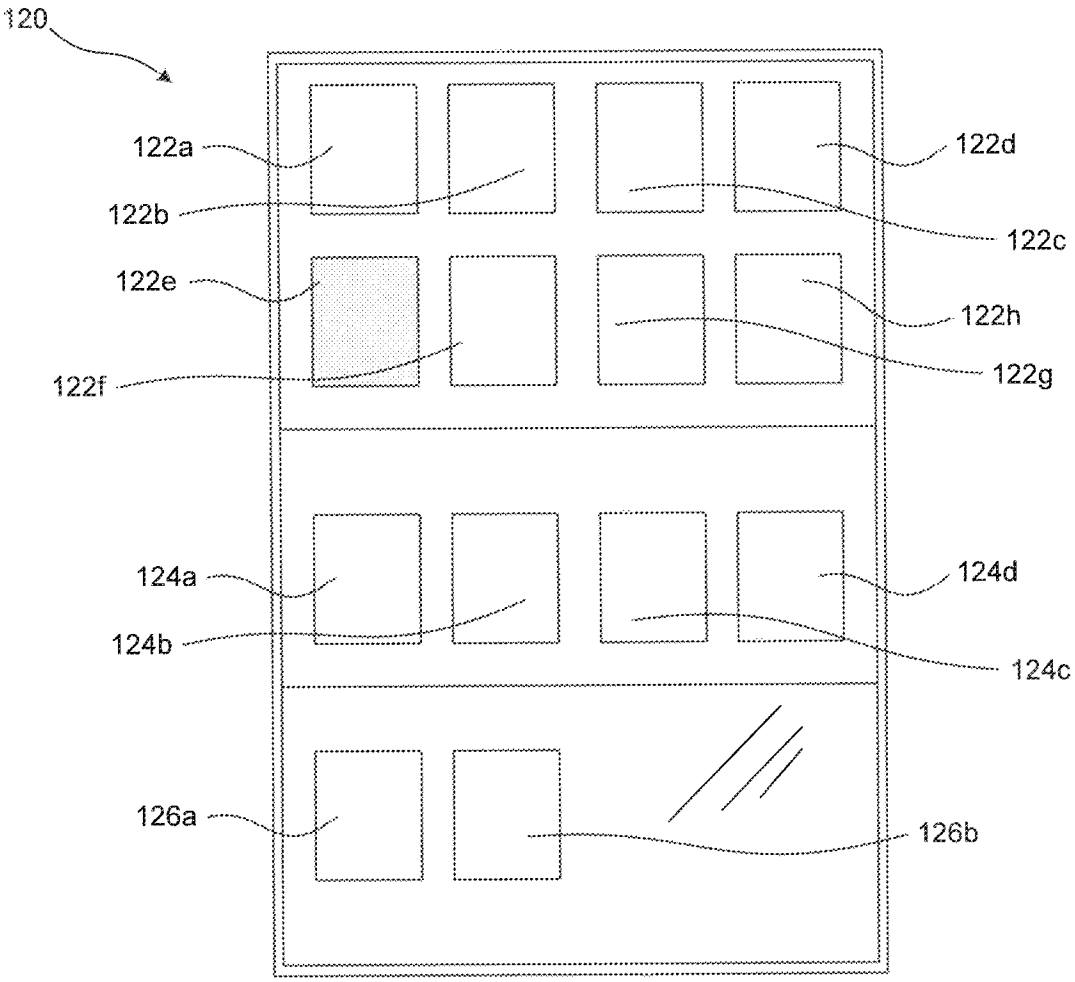
FIG. 5 is a front view of a display screen 120 according to various aspects of the invention.

In another aspect of the invention, sensor 330 can include an electro-mechanical device, for example, a microswitch, as shown in FIG. 5. The microswitch can be configured to be activated by sensor activation device 320. Sensor 330 can be positioned in interior area 360 such that a surface of sensor actuator 340 is directly exposed to channel 310 and sensor activation device 320 can interact with sensor actuator 340 to activate sensor 330. Sensor activation device 320 can include for example, a piston, or a ball, freely movable within inlet channel 310. As shown in FIG. 5, sensor actuator 340 may include, for example, a lever, a stem, a strip, or a cantilever. The flow of exhaust gas can be representative of a supply condition of pump 200 and can be include differed patterns based on the presence or absence of fluid concentrate from concentrate source 180. The flow of exhaust gas can push sensor activation device 320 into sensor actuator 340 to activate sensor 330 that generates electrical signals. The electrical signals can be received and processed by a control module.

In an aspect of the invention, sensing apparatus 300 can be connected to gas exhaust port 220 of pump 200 and can detect a supply condition of pump 200 based on a pattern of the exhaust gas leaving the pump 200 during pump operation. The patterns of the exhaust gas leaving the pump 200 can vary based on the "fill ratio" of fluid sources. Fill ratio, as described herein, is a ratio of the actual volume of fluid contained in a fluid source, including a fluid source container and the fluid in the supply line, to the total possible volume of the fluid source, including a fluid source container and the fluid in the supply line. For example, a completely full fluid source and fluid supply line will have a fill ratio of 1. Fill ratios can define a supply condition of concentrate source 180, beverage source BIB pump 200, supply line 244, or beverage source BIB pump 200 including supply line 244. In an aspect of the invention, a "filled" fluid source may have a fill ratio in the range of 0.35 or more, 0.4 or more, 0.5 or more, 0.6 or more, 0.7 or more, 0.8 or more, 0.9 or more, or 1.0. In other aspects, an "empty" or "low-level" beverage source may have a fill ratio of less than 0.35, less than 0.25, less than 0.1, and/or less than 0.05.

When beverage dispenser 100 is activated to dispense a beverage through dispensing valve 140, pump 200 can supply a beverage, a beverage concentrate, a syrup, and/or flavorings to beverage dispenser 100 through supply line 244. Pump 200 can exhaust gas through gas exhaust port 220 in a first gas exhaust pattern representative of a first supply condition of pump 200. Pump 200 can also exhaust gas in a second gas exhaust pattern representative of a second supply condition of pump 200. The first supply condition of pump 200 can be referred to as the "filled" state and second supply condition of pump 200 can be referred to as the "empty" or "low-level" state. In an aspect, the first supply condition and/or the second supply condition can be determined with respect to an average supply condition, as discussed below with respect to FIG. 9.

In an aspect of the invention, the exhausted gas from gas exhaust port 220 can exert a force on sensor activation device 320 disposed in inlet channel 310 such that sensor activation device 320 interacts with sensor actuator 340 to activate sensor 330. When activated, sensor 330 can generate a signal representative of a supply condition of pump 200. For example, the signal can be a first signal 382 representative of a first supply condition of the pump ("filled") or a second signal 384 representative of a second supply condition of the pump ("empty" or "low level"). The first signal 382 can be distinguished from second signal 384 based on the frequency, amplitude, and/or wavelength of the respective signals.

Figure 7A:
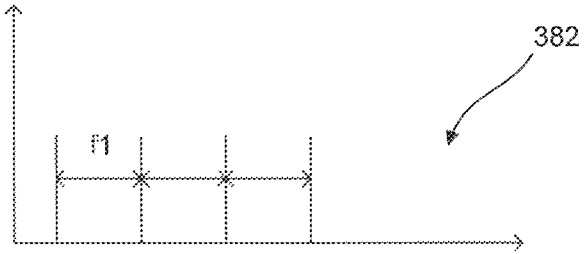
FIGS. 7A and 7B are schematic illustrations of signals generated by sensing apparatus 300 according to various aspects of the invention.
Figure 7B:
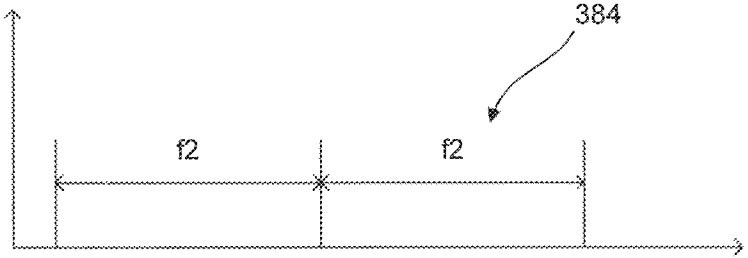
Figure 9:
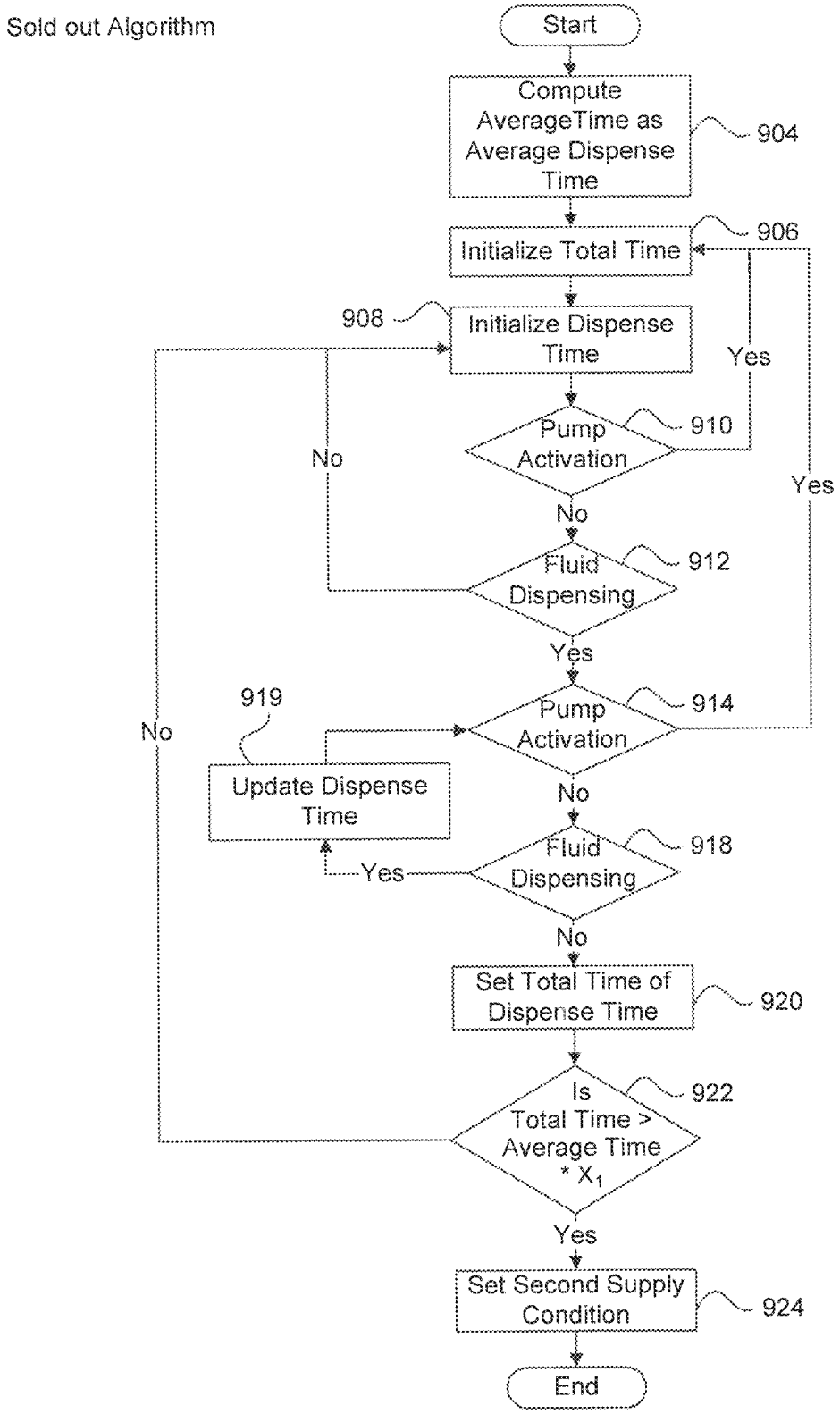
FIG. 9 is a process flow diagram of an example method for determining a supply condition of a beverage concentrate source according to various aspects of the invention.

The signal generated by a sensor 330 can include an electrical signal, an audio wave signal, a mechanical pulse signal, a light signal, a pressure signal, or combinations thereof. For example, first signal 382 can include an electrical signal having a uniform pulse frequency f1, as shown in FIG. 7A. In an aspect, f1 can range from approximately 1 Hz to approximately 0.02 Hz. Second signal 384 can include an electrical signal having a uniform pulse frequency f2, as shown in FIG. 7B. In an aspect, f2 can range from approximately 0.05 Hz to approximately 0.01 Hz. In some aspects of the invention, values of f1 and f2 are different. The first and second electrical signals (382, 384) can each have uniformly varying pulse frequencies. In some aspects of the invention, signals having different amplitudes, wavelengths, and the like can also be used to represent the supply condition of pump 200. In an aspect of the invention, f2 can be f1 divided by a sold-out factor $X_1$ (FIG. 9). In an aspect, $X_1$ can be approximately 3.

Figure 8:
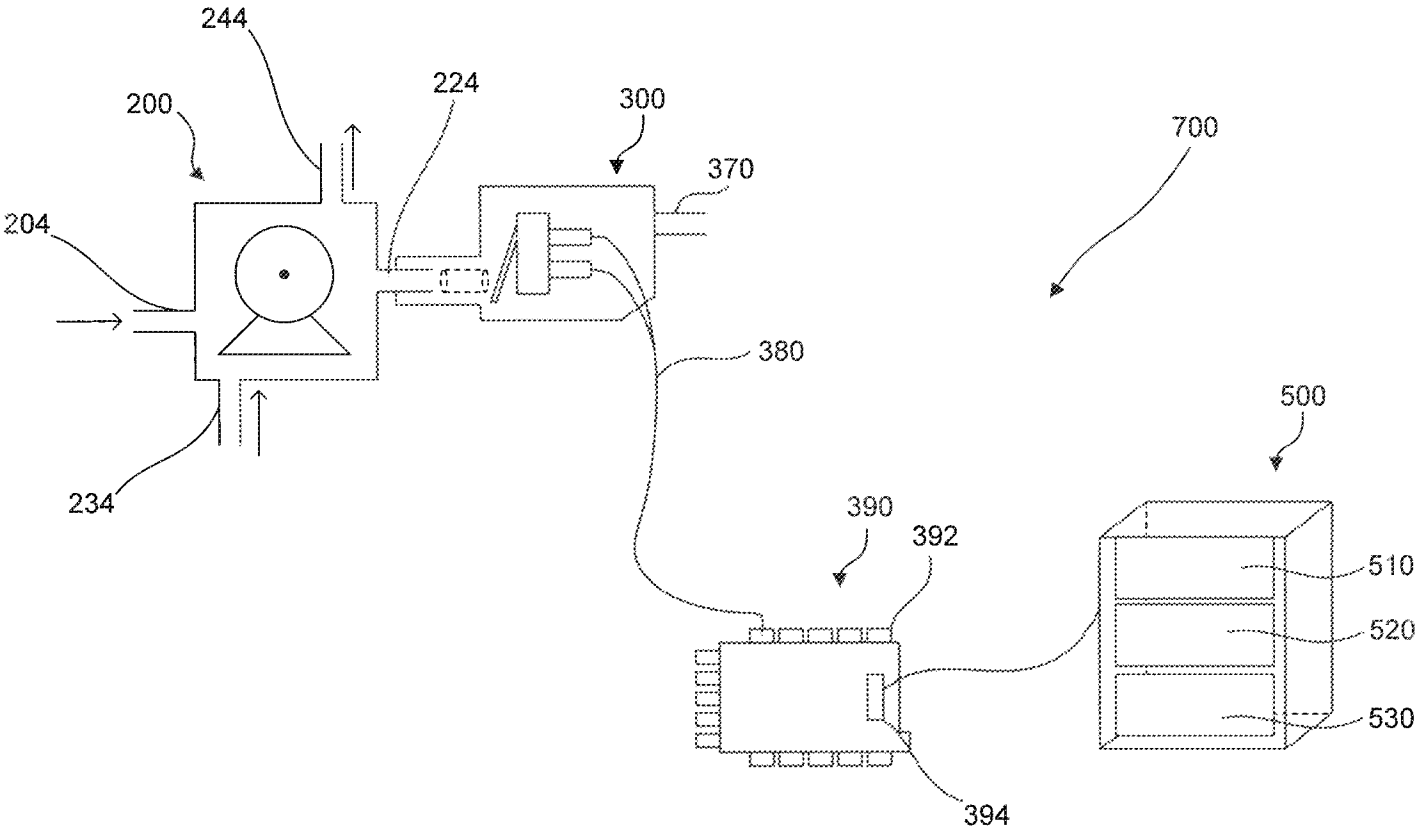
FIG. 8 is a schematic of sold-out assembly 700 according to various aspects of the invention.

FIG. 8 shows a schematic of a sold-out assembly 700. Sold-out assembly 700 can include one or more pumps 200, sensing apparatuses 300, sensors 330, sensor hubs 390, and/or control modules 500. In an aspect, sold-out assembly 700 can include a pump 200, a sensing apparatus 300, and a sensor for each beverage available in beverage dispensing system 10. In an aspect of the invention, as illustrated in FIG. 8, sensing apparatus 300 can be connected to gas exhaust port 220 of pump 200. Sensor 330 can be disposed within sensing apparatus 300 and electrically connected to sensor hub 390 through cables 380. Control module 500 can be electrically connected to sensor hub through cable 396. Each of the components of sold-out assembly 700 and their relationship will be described in greater detail in the following sections.

In sold-out assembly 700, sensor hub 390 can include one or more input connectors 392 configured to receive one or more cables 380. Sensor hub 390 can enable receiving generated signals from one or more sensors 330 in a beverage dispensing system 10 comprising one or more beverage types and one or more sensing apparatuses 300. Sensor hub 380 can also include an output connector 394 to electrically connect with control module 500 through cable 396, as shown in FIG. 8.

As illustrated in FIG. 1, control module 500 can be connected to beverage dispenser 100. In one aspect of the invention, control module 500 can be integrated with beverage dispenser 100. In another aspect, control module 500 can be a separate control module incorporated into each beverage dispenser 100. In a further aspect of the invention, control module 500 can include a processor 510, memory 520, software 530, and/or additional components suitable for implementing the functions and methods of dispensing system 10. Control module 500 can be configured to receive temperature control feedback from temperature probes installed on components of the beverage dispensing system 10. For example, a temperature probe installed on a chiller or a carbonator pump can be connected to control module 500. Control module 500 can be configured to monitor, record, and regulate temperature profiles of connected components.

As illustrated in FIG. 7, control module 500 can be configured to receive generated signals 382 and 384 from sensor 330 through sensor hub 390. Control module 500 can also be configured to execute an algorithm 540 based on generated signal data from sensors 330. As shown in FIG. 9, algorithm 540 can be configured to compare the generated signals 382, 384 and detect a change in pump behavior, or a pump gas exhaust pattern representative of a supply condition of pump 500. For example, algorithm 540 can compare the generated signals 382, 384 to a predetermined, stored signal data set corresponding to a filled supply condition or an empty supply condition of pump 200, respectively. In another aspect, algorithm 540 can compare the generated signals 382, 384 to a real-time signal data set corresponding to a filled supply condition that updates each time the pump operates. Algorithm 540 determines whether pump 200 is in a "filled" state, or an "empty" state based on the comparison results. The filled state corresponds to the normal-pour state and the empty state corresponds to the sold-out state of a beverage concentrate source. Once the algorithm has been executed and determines the empty state, control module 500 can prevent beverage dispensing system 10 from dispensing a sold-out beverage. For example, control module 500 can communicate the supply condition of pump 200 to a display screen 120 on the user interface of beverage dispensing system 10 to indicate that a beverage is sold out (FIG. 3). In an aspect, beverage dispensing system 10 can display a message that a beverage is sold out. In another aspect, beverage dispensing system 10 can disable a mechanical switch or a graphical user interface icon to prevent a user from selecting a sold out beverage. For example, the sold-out state of the beverage can be displayed as a text message on display screen 120, or a blackout of an icon for one or more of user input selections for beverage choice 122, or an audio-visual feedback to a user, or combinations thereof.

Figure 4:
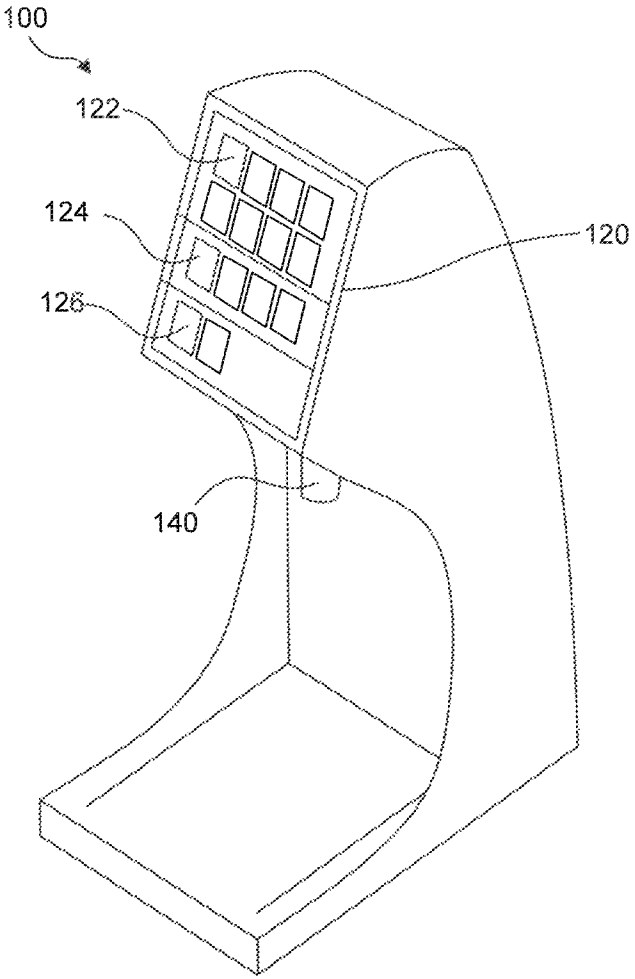
FIG. 4 is a perspective view of a beverage dispenser 100 according to various aspects of the invention.

As illustrated in FIG. 4, a beverage dispenser 100 can include one or more of a user interface such as a display screen 120. In some aspects of the invention, user interface can include, for example, an audio-visual interface (AVI), a graphic user interface (GUI), a touch screen display. A display screen 120 of user interface may display different user input selections for a beverage choice 122, input selections for beverage dispensing system operation controls 124, or input selections for beverage dispensing system maintenance controls 126. A user may make desired selections, such as selections of a desired brand of beverage and one or more modifiers or flavorings that can be used as ingredients for a custom beverage. The user interface can present all information required to select and dispense a beverage to a user, allow a system administrator to perform routine system maintenance, replenish the fluid source, customize display preferences of the user interface of the beverage dispensing system, and the like.

In some aspects of the invention, as illustrated in FIG. 5, user input selections 122*a*-122*h* can be icons for each type or brand of beverage that are available at beverage dispenser 100. User input selections for a beverage choice 122*a* -122*f* can be displayed on display screen 120. In one aspect of the invention, user input selection 122*a* can be an icon for Sierra Mist®, user input selection 122*b* can be an icon for Tropicana®, user input selection 122*c* can be an icon for Diet Pepsi-Cola®, user input selection 122*d* can be an icon for Pepsi-Cola®, user input selection 122*e* can be an icon for Lipton Brisk® Iced Tea, user input selection 122*f* can be an icon for Mountain Dew®, user input selection 122*g* can be an icon for Diet Mountain Dew®, and user input selection 122*h* can be an icon for MUG Root Beer®. Display screen 120 may also display one or more unassigned icons for beverage modifiers or flavorings for example, cherry, lemon, strawberry, lemon, and the like.

In an aspect of the invention, a user input selection for a beverage choice can be greyed out or rendered non-responsive to input based on a detected sold-out condition of a beverage. For example, FIG. 5 shows icon 122*e* greyed out to represent that the beverage associated with this icon is sold-out and not available from the beverage dispensing system. In an aspect, the user input selection will remain unavailable until the system is reset after the concentrate source 180 is replaced.

In display screen 120 of beverage dispenser 100, user input selections 124*a*-122*d* can be icons for operation controls for the beverage dispenser, or the beverage dispensing system, or both. In one aspect of the invention, user input selection 124*a* can be an icon for system reboot/shutdown, user input selection 124*a* can be an icon for volume adjustment of user interface, user input selection 124*c* can be an icon for sensor configuration, user input selection 124*d* can be an icon for fluid flow calibration.

In display screen 120 of beverage dispenser 100, user input selections 126*a*-126*b* can be icons for maintenance controls for the beverage dispenser, or the beverage dispensing system, or both. In one aspect of the invention, user input selection 126*a* can be an icon for preventive maintenance, user input selection 126*b* can be an icon for displaying system status.

In one aspect of the invention, when a sold-out state of a beverage in a beverage dispensing system 10 is identified, beverage dispensing system 10 can prevent a user from selecting the sold-out beverage until concentrate source 180 is restocked or replaced. Thus, in an aspect beverage dispensing system 10 can require a sold-out reset after concentrate source 180 is restocked or replaced to again make the sold-out beverage available for purchase. In one aspect, the reset can be accomplished via one or more input selections on display screen 120. In another aspect, as shown in FIG. 1, beverage dispensing system 10 can include a sensor 110 to detect when an empty concentrate source 180 is replaced, as discussed below with respect to FIG. 10. For example, sensor 110 can be a proximity sensor to detect the presence of maintenance personnel during replacement of concentrate source 180. In an aspect, sensor 110 can transmit a signal to control module 500 to reset the sold-out state of a beverage in a beverage dispensing system 10. In some aspects of the invention, sensor 110 can also be configured to detect false sold-out signals.

Sensor 110 can be configured to be connected with beverage dispenser 100. Sensor 110 can also be located, but not limited to, in line with fluid inlet line 234 and pump 200, in line with gas exhaust line 224 of pump 200, or in line with fluid supply line 244 and beverage dispenser 100. In further aspects of the invention, sensor 110 can include a motion sensor, a presence sensor, an electro-magnetic sensor, a microphone, a flowmeter, or other suitable sensing device. In other aspects of the invention, sensor 110 can be in wireless communication with control module 500. Sensor 110 can also be in wireless communication with beverage dispenser 100.

In some aspects of the invention, sensor 110 can be in wireless communication with a remote server configured to store information about a sold-out state of a beverage, frequency of occurrence of sold-out state of a beverage, update inventory information of concentrate source 180, and the like.

In an aspect of the invention, a method to determine a sold out state of a beverage in a beverage dispensing system 10 can include one or more of the following steps, as shown in FIG. 9. Steps 904-924 in FIG. 9 show a process flowchart for algorithm 540 for determining a sold-out state of a beverage in beverage dispensing system 10 based on the supply condition of pump 200. In an aspect, algorithm 540 can include steps 904-924.

The method in FIG. 9 can include providing a beverage dispenser 100 including a pump 200 having a gas exhaust port 220, a dispensing valve 140, and a sensor 330 disposed on the pump gas exhaust port 220. Beverage dispenser 100 can be activated manually or automatically to dispense beverage through dispensing valve 140. Beverage dispenser 100 can be equipped with sensing devices, e.g. motion detectors, presence sensors, and the like.

At step 904, algorithm 540 can compute Average Time based on the Average Dispense Time. Each supply and exhaust of the compressed air to a diaphragm in pump 200 is a pump activation. Fluid continues to dispense for each pump activation during operation of the pump. In an aspect, the Average Dispense Time can be the average amount of time between each pump activation during pump operation. In an aspect, the Average Dispense Time can vary during operation of pump 200. For example, because the pump is drawing fluid from a fixed volume source, e.g. concentrate source 180, the Average Dispense Time can increase due to increased source pressure as the amount of fluid in the fixed volume source decreases. The amount of time between pump activations can range from approximately 1 second for a full concentrate source 180, i.e. normal-pour state, to approximately 50 seconds for an empty concentrate source 180, i.e. sold-out state.

At step 906, algorithm 540 can initialize Total Time. In an aspect, step 906 can first occur when beverage dispenser 10 begins dispensing a beverage and pump 200 beings operating to supply a concentrate from concentrate source 180.

At step 908, algorithm 540 can initialize Dispense Time. In an aspect, step 906 and step 908 can occur simultaneously.

At step 910, algorithm 540 can determine whether pump 200 is activating. For example, whether compressed air is being supplied to pump 200 and subsequently exhausted, thus activating sensor 330. If algorithm 540 determines activation of pump 200, algorithm 540 proceeds to step 906 and again initializes the Total Time. If algorithm 540 determines pump 200 is not activating, algorithm 540 proceeds to step 912.

At step 912, algorithm 540 can determine whether pump 200 is operating and dispensing fluid. If algorithm 540 determines pump 200 is not operating and dispensing fluid, algorithm 540 proceeds to step 908 and again initializes the Dispense Time. If algorithm 540 determines pump 200 is operating and dispensing fluid, algorithm 540 proceeds to step 914.

At step 914, algorithm 540 can determine whether pump 200 is activating. For example, whether compressed air is being supplied to pump 200 and subsequently exhausted, thus activating sensor 330. If algorithm 540 determines activation of pump 200, algorithm 540 proceeds to step 906 and again initializes the Total Time. If algorithm 540 determines pump 200 is not activating, algorithm 540 proceeds to step 918.

At step 918 algorithm 540 can determine whether pump 200 is operating and dispensing fluid. If algorithm 540 determines pump 200 is operating and dispensing fluid, algorithm 540 updates the Dispense Time counter to include the total amount of time that has passed since the last pump activation and proceeds again to step 914. This loop in algorithm 540 between steps 914 and 918 repeats as pump 200 is operating and dispensing fluid without activating pump 200. In an aspect, the Dispense Time can range from approximately one second to approximately 50 seconds. If algorithm 540 determines pump 200 is not operating and dispensing fluid, algorithm 540 proceeds to step 920.

At step 920, algorithm 540 updates the Total Time to be the Dispense Time. Thus, at step 920 the Total Time is representative of the total amount of time that has passed since the last pump activation to when pump 200 stopped operating and dispensing fluid.

At step 922, algorithm 540 compares the Total Time to the Average Time (step 904) multiplied by sold-out factor $X_1$. If the Total Time is greater than Average Time*$X_1$, algorithm 540 proceeds to step 908 and again initializes the Dispense Time. If the Total Time is less than Average Time*$X_1$, algorithm 540 proceeds to step 924.

At step 924, algorithm 540 sets the second supply condition. For example, algorithm 540 sets a sold-out state for a beverage.

Figure 10:
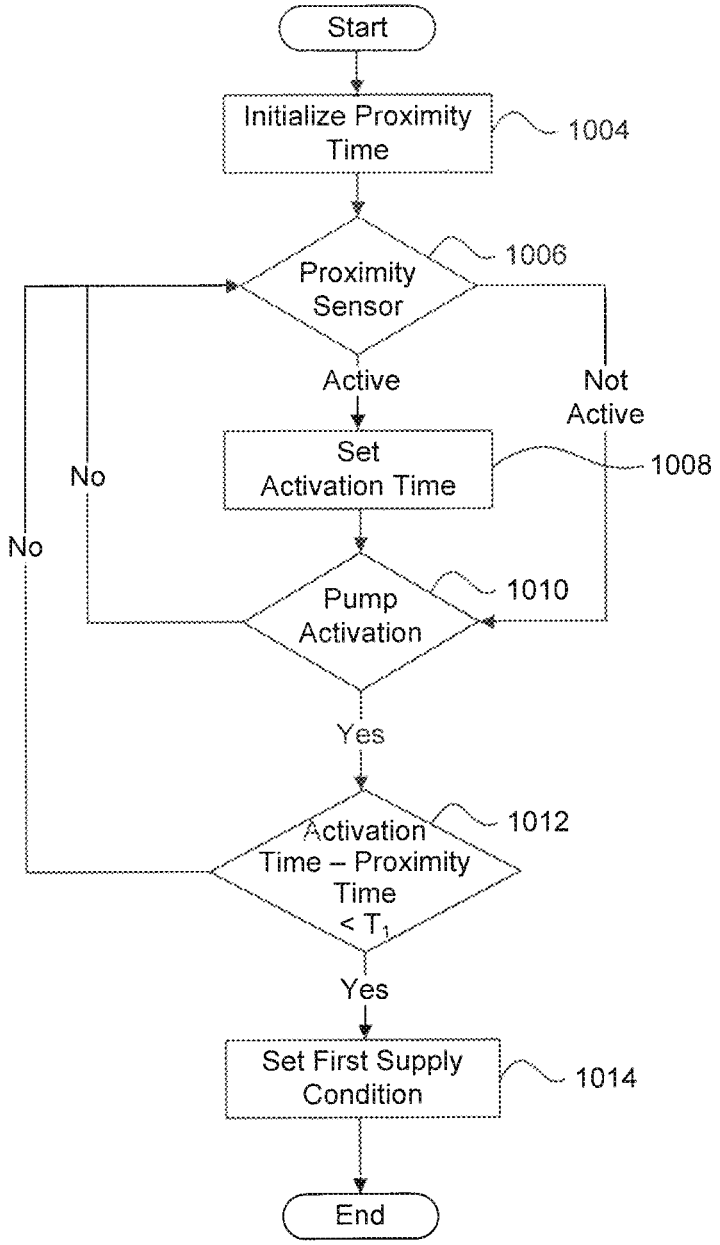
FIG. 10 is a process flow diagram of an example method for determining a supply condition of a beverage concentrate source according to various aspects of the invention.

In an aspect of the invention, a method to determine sold-out state of a beverage in a beverage dispensing system 10 can include one or more of the following steps, as shown in FIG. 10. Steps 1004 to 1014 in FIG. 10 show a process flowchart for determining a sold-out state of a beverage in beverage dispensing system 10 based on the supply condition of pump 200. In an aspect, algorithm 540 can include steps 1004-1014.

The method in FIG. 10 can include providing, a beverage dispenser 100 including a pump 200 having a gas exhaust port 220, a dispensing valve 140, and a sensor 330 disposed on the pump gas exhaust port 220. Beverage dispense 100 can include a sensor 110 to detect when an empty concentrate source 180 is replaced. Sensor 110 can be a proximity sensor. Beverage dispenser 100 can be activated manually or automatically to dispense beverage through dispensing valve 140. Beverage dispenser 100 can be equipped with sensing devices, e.g. motion detectors, presence sensors, and the like.

At step 1004, algorithm 540 can initialize Proximity Time.

At step 1006, algorithm 540 can determine whether sensor 110 is active. If sensor 110 is active, algorithm 540 can proceed to step 1008. If algorithm 540 determines that sensor 110 is not active, algorithm 540 can proceed to step 1010.

At step 1008, algorithm 540 can set Activation Time.

At step 1010, algorithm 540 can determine whether pump 200 is operating and dispensing fluid. If algorithm 540 determines pump 200 is not operating and dispensing fluid, algorithm 540 can proceed to step 1006 to again determine whether sensor 110 is active. If algorithm 540 determines pump 200 is operating and dispensing fluid, algorithm 540 can proceed to step 1012.

At step 1012, algorithm 540 can compare the Activation Time to the Proximity Time. If the Activation Time minus the Proximity time is greater than $T_1$, algorithm 540 can proceed to step 1006 and again determine whether sensor 110 is active. If the Activation Time minus the Proximity time is less than $T_1$, algorithm 540 can proceed to step 1014. In an aspect, T1 can be approximately 60 seconds.

At step 1014, algorithm 540 can set the first supply condition. For example, algorithm 540 can set a normal-pour state for a beverage.

In an aspect of the invention, the method of FIG. 10 can occur after a sold-out state is set for a beverage.

Figure 11:
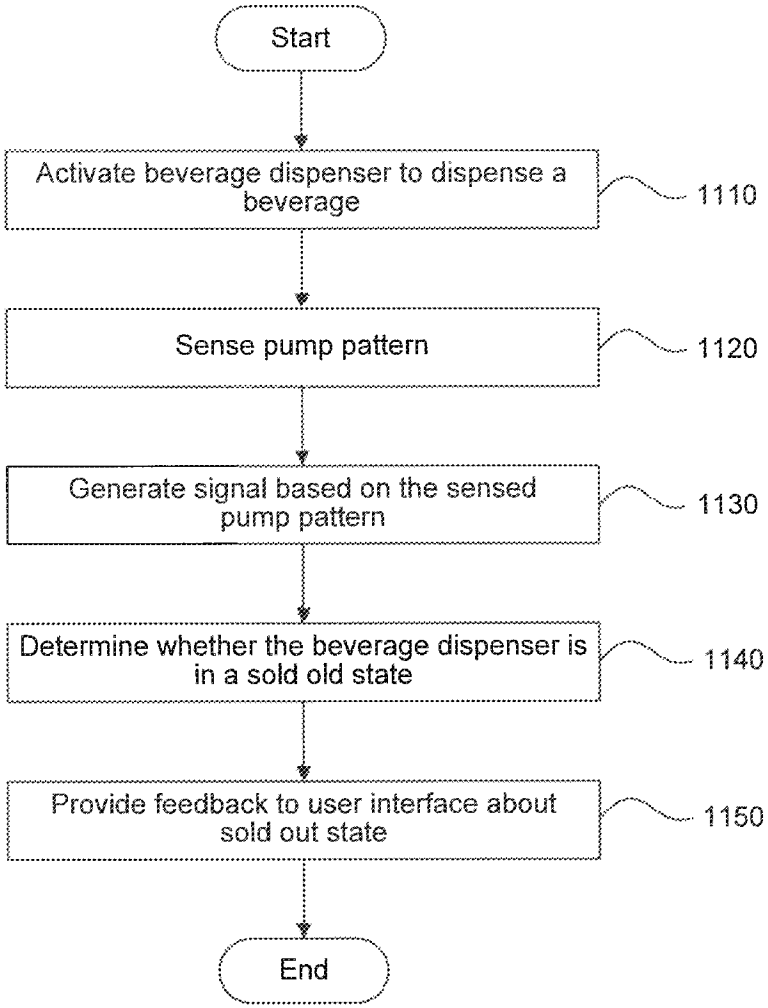
FIG. 11 is a block diagram of an example method for determining a supply condition of a beverage concentrate source according to various aspects of the invention.

In an aspect of the invention, a method to determine sold-out state of a beverage in a beverage dispensing system 10 can include one or more of the following steps, as shown in FIG. 11. Steps 1110 to 1150 in FIG. 11 show a process flowchart for determining sold-out state of a beverage in a beverage dispensing system 10 including pump gas exhaust sensors.

At step 1110, a method to determine sold-out state of a beverage in a beverage dispensing system 10 can include providing a beverage dispenser 100 including a pump 200 having a gas exhaust port 220, a dispensing valve 140, and a sensor 330 disposed on the pump gas exhaust port 220. Beverage dispenser 100 can be activated manually or automatically to dispense beverage through dispensing valve 140. Beverage dispenser 100 can be equipped with sensing devices, e.g. motion detectors, presence sensors, and the like.

At step 1120, sensor 330 of a sensing apparatus 300 can sense pump gas exhaust pattern during activation of beverage dispenser 100.

At step 1130, a signal can be generated based on the sensed gas exhaust pattern representative of a supply condition of pump 200. In one aspect, a first signal 382 can be generated based on the sensed first gas exhaust pattern representative of a first supply condition of pump 200 and a second signal 384 can be generated based on the sensed second gas exhaust pattern representative of a second supply condition of pump 200.

At step 1140, control module 500 can determine the supply condition of pump 200 based on the generated signal from sensor 300 disposed on gas exhaust port 220 using an algorithm to compare first and second signals 382, 384. Algorithm 540, discussed above with respect to FIGS. 9-10, can detect changes in generated signals represented by gas exhaust patterns of pump 200. In one aspect, a first generated signal can represent a first gas exhaust pattern corresponding to a "filled" supply condition of pump 200. Algorithm 540 can detect the first signal 382 and identify a filled supply condition, and can communicate the results of execution of the algorithm 540 to control module 500. In another aspect, a second signal 384 may represent a second gas exhaust pattern corresponding to an "empty" supply condition of pump 200. Algorithm can detect the second generated signal and identify an "empty" supply condition, and can communicate the results of execution of the algorithm 540 to control module 500. In a further aspect of the invention, a third signal may represent a third gas exhaust pattern corresponding to a "low-level" supply condition of pump 200. Algorithm 540 can detect a third signal corresponding to a "low-level" supply condition of the pump and communicate the results of execution of the algorithm 540 to control module 500. In another aspect of the invention, algorithm 540 can compare a current gas exhaust pattern to a previously determined average gas exhaust pattern.

At step 1150, control module 500 can provide feedback to a display screen 120 of a user interface about the supply condition of pump 200. An "empty" supply condition identified by algorithm 540 can indicate a sold-out state of a beverage at beverage dispenser 100 in beverage dispensing system 10.

In an aspect of the invention, beverage dispenser 100 can be configured to dispense one or more beverages. Each beverage can be assigned a separate pump 200 and a separate sensing apparatus 300 can be connected to gas exhaust port 220 of each pump 200. In one aspect, a sold-out state for a particular beverage on a beverage dispenser 100 can be determined for an individual beverage without interrupting the availability of other beverages from beverage dispensing system 10.

Figure 12:
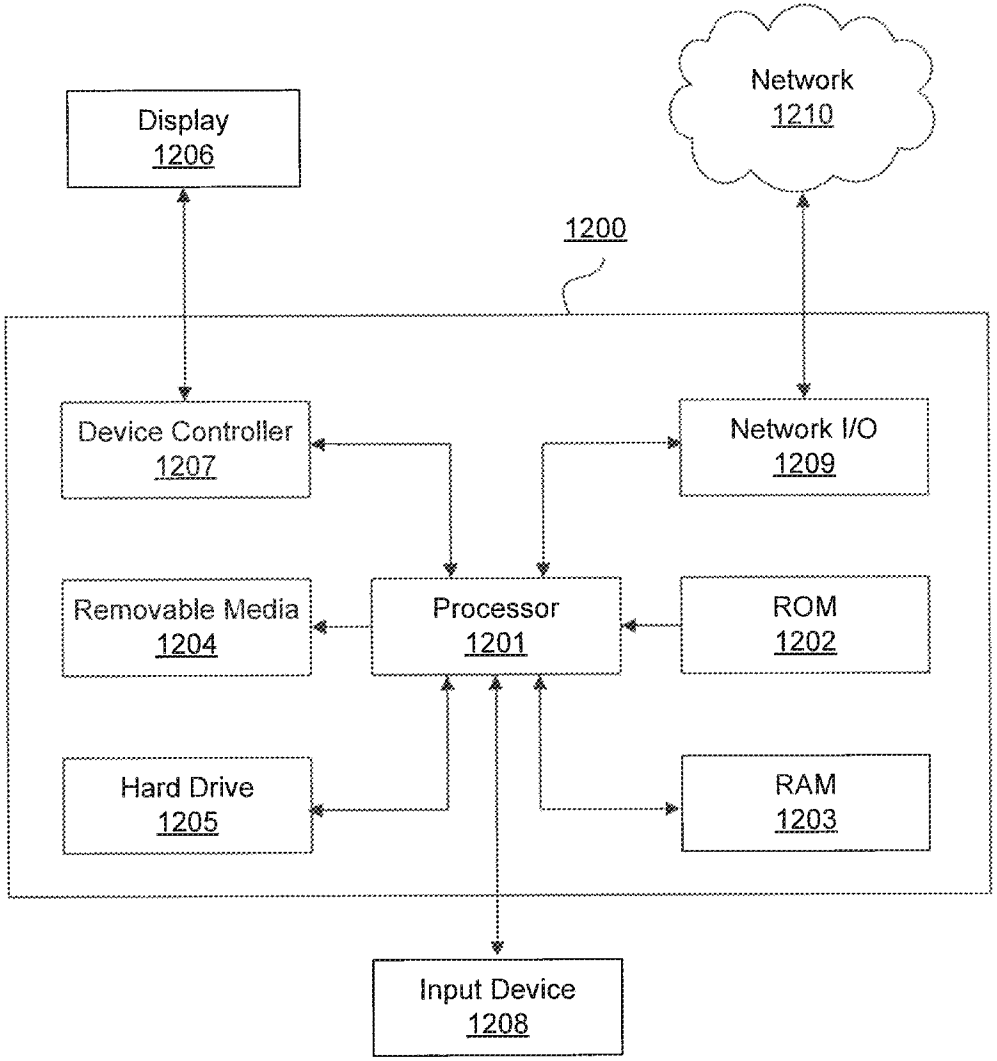
FIG. 12 illustrates an example hardware platform according to various aspects of the invention.

FIG. 12 illustrates an example computing device on which at least some of the various elements described herein can be implemented, including, but not limited to, various components of dispenser systems (e.g., dispensers 100, beverage dispensing system 10). Computing device 1200 can include one or more processors 1201, which may execute instructions of a computer program to perform, or cause to perform, any of the steps or functions described herein. The instructions can be stored in any type of computer-readable medium or memory, to configure the operation of the processor 1201. For example, instructions can be stored in a read-only memory (ROM) 1202, random access memory (RAM) 1203, removable media 1204, such as a Universal Serial Bus (USB) drive, compact disk (CD) or digital versatile disk (DVD), floppy disk drive, flash card, or any other desired electronic storage medium. Instructions can also be stored in an attached (or internal) hard drive 1205.

Computing device 1100 can include one or more output devices, such as a display 1206, and can include one or more output device controllers 1207, such as a video processor. There can also be one or more user input devices 1208, such as a touch screen, remote control, keyboard, mouse, microphone, card reader, RFID reader, etc. The computing device 1100 can also include one or more network interfaces, such as input/output circuits 1209 to communicate with an external network 1210. The network interface can be a wired interface, wireless interface, or a combination of the two. In some embodiments, the interface 1209 can include a modem (e.g., a cable modem), and network 1210 can include the communication lines of a networks.

The FIG. 12 example is an illustrative hardware configuration. Modifications can be made to add, remove, combine, divide, etc. components as desired. Additionally, the components illustrated can be implemented using basic computing devices and components, and the same components (e.g., processor 1201, storage 1202, user input device 1208, etc.) can be used to implement any of the other computing devices and components described herein.

One or more aspects of the invention can be embodied in a computer-usable data and/or computer-executable instructions, such as in one or more program modules, executed by one or more computers or other devices. Generally, program modules include routines, programs, objects, components, data structures, etc. that perform particular tasks or implement particular abstract data types when executed by a processor in a computer or other data processing device. The computer executable instructions can be stored on one or more computer readable media such as a hard disk, optical disk, removable storage media, solid state memory, RAM, etc. The functionality of the program modules can be combined or distributed as desired in various embodiments. In addition, the functionality may be embodied in whole or in part in firmware or hardware equivalents such as integrated circuits, field programmable gate arrays (FPGA), controllers, application-specific integrated circuits (ASICS), combinations of hardware/firmware/software, and the like. Particular data structures may be used to more effectively implement one or more aspects of the invention, and such data structures are contemplated within the scope of computer executable instructions and computer-usable data described herein.

Figure 13:
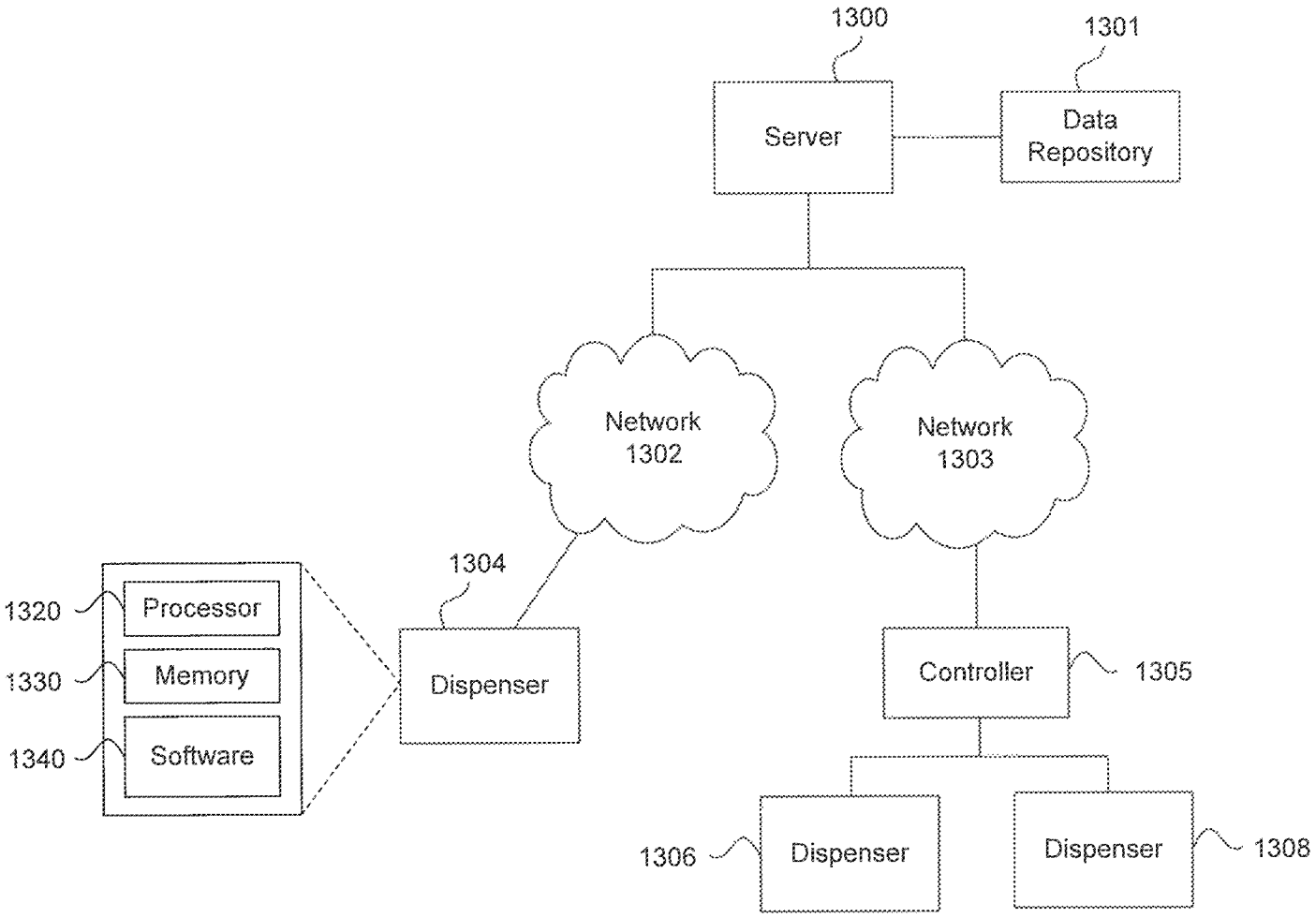
FIG. 13 is a block diagram of an example communication network according to various aspects of the invention.

FIG. 13 illustrates a block diagram of an example communication network in which one or more embodiments can be implemented. A dispensing system, e.g., beverage dispensing system 10, can be configured, to dispense a product according to a user's selection. For example, a user can approach a dispenser 1304, and interact with dispenser 1304 to make a selection (e.g., input a code or press a button corresponding to the desired product). In response, the dispenser 1304 can dispense the selected product. In general, examples of this disclosure relate to a beverage dispensing system 10; however, various aspects of this disclosure could be used in a dispenser for other types of products (e.g., candy or snack dispenser).

Dispensing systems may be located across different locations or premises. For example, FIG. 13 illustrates three dispensers: dispenser 1304, dispenser 1306 and dispenser 1308.

In a further aspect, dispensers can be connected to a controller. A controller may be centrally located and/or a separate controller can be incorporated into each dispenser. As illustrated in FIG. 13, dispensers 1306 and 1308 are connected to controller 1305. Controller 1305 can be configured to receive instructions from dispensers 1306 and/or 1308, and to cause the appropriate dispensing system to dispense an appropriate amount of the selected product. For example, if dispenser 1306 is a beverage dispenser, a user may interact with the dispenser to select a beverage (e.g., via a touchpad, touch screen, keypad, etc.), instructions for the selected beverage can be transmitted to controller 1305, and controller 1305 can be configured to dispense an appropriate amount of the selected beverage in response to the instructions.

Components of a dispenser 1304 can include a processor 1320, memory 1330, software 1340, and/or additional components suitable for implementing the functions and methods of the dispensing system. Software 1340 can be stored in computer-readable memory 1330 such as read only or random access memory in dispenser 1304 and may include instructions that cause one or more components (e.g., processor 1320, display, etc.) of a dispenser (e.g., dispenser 1304) to perform various functions and methods including those described herein.

A dispenser can communicate with other devices using one or more networks. For example, as illustrated in FIG. 13, dispensing systems 1304, 1306 and 1308 can communicate with server 1300 via network 1302 and/or network 1303. Network 1302 and network 1303 can include multiple networks that are interlinked so as to provide internetworked communications. Such networks can include one or more private or public packet-switched networks (e.g., the Internet), one or more private or public circuit-switched networks (e.g., a public switched telephone network), a cellular network, a short or medium range wireless communication connection (e.g., Bluetooth®, ultra wideband (UWB), infrared, WiBree, wireless local area network (WLAN) according to one or more versions of Institute of Electrical and Electronics Engineers (IEEE) standard no. 802.11), or any other suitable network. Devices in communication with each other (e.g., dispensing systems 1304, 1306, and 1308, server 1300, and/or data repository 1301) can use various communication protocols such as Internet Protocol (IP), Transmission Control Protocol (TCP), Simple Mail Transfer Protocol (SMTP), File Transfer Protocol (FTP), among others known in the art.

Server 1300, controller 1305, and dispensers 1304, 1306 and 1308 can be configured to interact with each other and other devices. In one example, dispenser 1304 can include software 1340 that is configured to coordinate the transmission and reception of information to and from server 1300. In one arrangement, software 1340 can include application or server specific protocols for requesting and receiving data from server 1300. For example, software 1340 can comprise a browser or variants thereof and server 1300 may comprise a web server. In some arrangements, server 1300 may transmit application data to dispensing systems, such as software updates to various components of the dispensers (e.g., updates to the user interface, updates to firmware of the dispensers, updates to drivers of the dispensing system, etc.). In one or more arrangements, server 1300 can receive data from the dispensers, such as data describing the current stock of the dispenser (e.g., a listing of products and the number remaining at the dispenser), operation history and/or usage metrics of the dispenser (e.g. counters tracking the selections of users of the machine), status of the dispenser (e.g., whether any components are working improperly), etc. Server 1300 may be configured to access and store data in data repository 1301, such as data that it receives and transmits in data repository 1301. Data repository 1301 may also include other data accessible to server 1300, such as different drink recipes that can be downloaded to dispensers.

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventor(s), and thus, are not intended to limit the present invention(s) and the appended claims in any way.

The present invention(s) have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention(s) that others can, by applying knowledge within the skill of the art, readily modify and/or adapt for various applications such specific embodiments, without undue experimentation, without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention(s) should not be limited by any of the above-described exemplary embodiments, but should be defined only in accordance with the following claims and their equivalents.

What is claimed is:

1. A sensing apparatus for a beverage dispenser, comprising:

a sensor housing having an interior area fluidly connected to a pump gas exhaust port; and a sensor positioned within the interior area, wherein the sensor detects a characteristic of an exhaust gas flowing through the gas exhaust port, the characteristic selected from the group consisting of exhaust gas flow rate, exhaust gas sound, and exhaust gas flow duration, wherein the sensor generates a first signal based on the detected characteristic, the first signal being representative of a first supply condition that indicates a filled pump, and wherein the sensor generates a second signal based on the detected characteristic, the second signal being representative of a second supply condition that indicates an empty pump.

2. The sensing apparatus of claim 1, further comprising a sensor activation device disposed in a channel, the channel connecting the interior area to the pump exhaust port, wherein the sensor activation device interacts with the sensor to generate one of the first and the second signal.

3. The sensing apparatus of claim 1, wherein the sensor is selected from a group consisting of a microphone, a flow-meter, an electromagnetic device, and an electromechanical device.

4. The sensing apparatus of claim 1, wherein the pump supplies a beverage concentrate.

5. The sensing apparatus of claim 1, wherein the pump is a compressed-gas powered positive displacement pump.

6. A method of determining a sold-out state of a beverage dispenser, the method comprising:

providing a beverage dispenser including:

a pump having a gas exhaust port, a dispensing valve, and a sensor disposed on the pump gas exhaust port;

activating the beverage dispenser to dispense a beverage through the dispensing valve;

during the activating, sensing a gas exhaust pattern of the pump;

generating a signal based on the sensed gas exhaust pattern, wherein the signal is a first signal based on a first gas exhaust pattern representative of a filled state of a concentrate container or a second signal based on a second gas exhaust pattern representative of a sold-out state of the concentrate container, and wherein the first signal has a higher frequency than the second signal; and determining whether the beverage dispenser is in a sold-out state.

7. The method of claim 6, wherein a control module is configured to receive the first and the second signal, and wherein the control module determines a state of the concentration container based on the received signal.

8. The method of claim 7, wherein determining the state of the beverage dispenser comprises comparing the signal to a stored signal using an algorithm.

9. The method of claim 6, further comprising providing feedback about the sold-out state to a user interface of the beverage dispenser.

10. The method of claim 6, wherein the sensor is selected from a group consisting of a microphone, a flow-meter, an electromagnetic device, and an electromechanical device.

11. A beverage dispensing system comprising:

a beverage dispenser including a pump;

a sensor connected to a gas exhaust port of the pump to generate a first signal representative of a first supply condition of the pump and a second signal representative of a second supply condition of the pump, wherein the first supply condition is a filled state and the second supply condition is an empty state, and wherein the sensor detects a characteristic of an exhaust gas flowing through the gas exhaust port, the characteristic selected from the group consisting of exhaust gas flow rate, exhaust gas sound, and exhaust gas flow duration;

a control module configured to communicate with the sensor;

a user interface in communication with the control module configured to provide feedback to a user, wherein the feedback comprises a sold-out state of the beverage dispenser.

12. The beverage dispensing system of claim 11, wherein the control module is configured to determine a state of the beverage dispenser based on the generated signal using an algorithm.

13. The beverage dispensing system of claim 11, wherein the sensor is contained within an interior area of a sensor housing, the sensor housing having an interior area fluidly connected to the pump gas exhaust port.

14. The beverage dispensing system of claim 11, wherein the sensor includes an activation portion that activates the sensor to generate one of the first and the second signal.

15. The beverage dispensing system of claim 11, further comprising a pressure supply source, a diluent supply source, and a beverage concentrate source connected to the beverage dispenser.

16. The beverage dispensing system of claim 11, wherein the first supply condition represents a partially full pump.

17. The beverage dispensing system of claim 11, wherein the sensor is a microphone, a flow-meter, or an electromechanical device.

* * * * *